US005806676A

United States Patent [19]

Wasgien

[11] Patent Number: 5,806,676

[45] **Date of Patent: *Sep. 15, 1998**

[54] DEVICE FOR PACKAGING BINDING ELEMENTS

[75] Inventor: Peter Wasgien, Heubach, Germany

[73] Assignee: Chr. Renz GmbH & Co., Heubach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 704,792

[22] PCT Filed: Oct. 6, 1994

[86] PCT No.: PCT/EP94/03305

§ 371 Date: Sep. 9, 1996

§ 102(e) Date: Sep. 9, 1996

[87] PCT Pub. No.: WO95/25047

PCT Pub. Date: Sep. 21, 1995

[30] Foreign Application Priority Data

Mar. 16, 1994 [DE] Germany ..... 94 04 459 U

[51] Int. Cl.[6] ..... B65D 73/00

[52] U.S. Cl. ..... 206/341; 206/338

[58] Field of Search ..... 206/338, 340, 206/341, 348, 493, 488, 489, 482, 483, 477, 486, 495

[56] References Cited

U.S. PATENT DOCUMENTS

| | | | |
|---|---|---|---|
| 1,343,651 | 6/1920 | Stafford | 206/348 |
| 1,356,588 | 10/1920 | Bacher . | |
| 1,389,188 | 8/1921 | Elliott | 206/348 |
| 1,734,032 | 11/1929 | Evans | 206/83 |
| 2,178,067 | 10/1939 | Cohen | 206/482 |
| 2,845,758 | 8/1958 | Lowthian | 206/486 |
| 3,270,877 | 9/1966 | Hecker . | |
| 4,173,283 | 11/1979 | Takamatsu | 206/338 |
| 4,761,086 | 8/1988 | Peterpaul | 206/493 |

FOREIGN PATENT DOCUMENTS

| | | | |
|---|---|---|---|
| 471746 | 9/1937 | United Kingdom | 206/482 |

*Primary Examiner*—Paul T. Sewell
*Assistant Examiner*—Luan K. Bui
*Attorney, Agent, or Firm*—Welsh & Katz, Ltd.

[57] ABSTRACT

A device for packaging continuous length spiral binding combs used for the binding of loose-leaf systems, in particular, annular calendars, note books, planners, catalogs or advertising papers. The package includes a carrier plate having a row of comb holders, each having opposing retaining strips pivoting outwardly to an open position for securing the binding combs and being in the shape of an H, for engaging nonadjacent combs to hold a bottom portion of the comb on the carrier plate.

7 Claims, 3 Drawing Sheets

DEVICE FOR PACKAGING BINDING ELEMENTS

BACKGROUND OF THE INVENTION

The invention relates to a device which packages annular or spiral binding combs for binding loose-leaf systems, in particular annular calendars, notebooks, planners, catalogues or advertising papers.

The said loose-leaf systems may for example be collated with such binding combs, which may also be designated as binding elements.

The binding combs are annularly or spirally shaped and are normally produced from wire. The wire may be made from plastics or also from a metallic material, which where appropriate may be provided with a plastic coating.

Previously the prefabricated, i.e. the annular or oval binding combs usually consisting of many loops and turns, spirally shaped and still open in their longitudinal direction were wound, transported and stored as endless material on rolls. If necessary they were only then cut to size corresponding to the format of the loose-leaf systems to be bound.

In this case inter alia the relatively high weight of the rolls to be transported is to be regarded as a disadvantage. By virtue of the very high quantity of binding combs, the described rolls are suitable only for large consumers, however not for occasional use or for users who only require small quantities of the described binding combs.

Since the loose-leaf systems have very different formats and divisions and consequently different lengths of the binding combs are required, the dimension to be cut has always to be newly measured in each case.

For this reason already cut-to-size smaller quantities of binding combs were already offered in so-called blister packs.

However, by virtue of the blister made of a plastic, blister packs do not take sufficient consideration of modern environmental awareness, and furthermore both manufacturing and disposal costs for the blister are relatively high.

A device for presenting textiles such as transverse binders is known from U.S. Pat. No. 1,356,588.

In this case the device is designed in many parts and the transverse binders are inserted into a depression in the device, with four elastically deformable retaining strips being biased and the retaining strips clamping each transverse binder at its outer sides so that the transverse binder is retained in the device.

The object of the present invention is to create a device of the type mentioned at the beginning, which is made from an environmentally friendly material, can be produced without great expenditure and which in a simple manner enables a secure and easy packaging for already cut-to-size binding combs.

SUMMARY OF THE INVENTION

This object is achieved in accordance with the invention by a carrier plate which has several rows of elastically bendable retaining strips, which surround the cut-to-size binding combs partially in their base region.

As a result a simple and secure packaging and respectively a stable base for the binding combs is created. The binding combs which have already been cut to size and consequently adapted to the formats of the loose-leaf systems can be applied graded to the carrier plate.

Since they are only partially surrounded by the retaining strips, the binding combs can be removed easily and quickly also by hand for binding the loose-leaf systems. The carrier plates with the provided binding combs can furthermore be easily stacked and can be stored and transported in an ideal manner in matching containers.

If the containers are for example characterised with the corresponding format details, fast access for the subsequent binding operation is guaranteed.

By surrounding the binding combs in their base region is to be understood that each retained turn or each retained loop of the annularly or spirally shaped binding combs is retained at the same region in the retaining strips. In the case of a binding comb having an oval shape when seen in cross section and for example still open at the top, the base region is that broad side which lies opposite the open part. In particular with this shape it is possible to fix the binding combs on the carrier plate so that warping, twisting, changes in shape or a fast sliding out can be avoided. Moreover the stacking of carrier plates provided with binding combs on top of one another can take place very uniformly and evenly.

A very advantageous development of the invention may lie in that the elastically bendable retaining strips are constructed in an H-shape.

The "H" shape has proved to be the most expedient during experiments.

The stamping method is the most effectively applicable for its manufacture.

In this case the simplest procedure is if the retaining strips are worked directly into the carrier plate. Above and below the crossweb existing with this "H" shape rectangular strips are produced, with which an elastic behaviour can be most suitably produced. This behaviour is necessary for the bending of these strips for the purpose of introducing the binding combs and their springing back after provision for the purpose of retaining the binding combs.

The invention may furthermore be positively developed if the spacings between the rows of retaining strips and also the spacings and divisions between the individual retaining strips within the rows can be varied in dependence on the size and packing density of the binding combs.

Consequently it is possible to use carrier plates formatted in the same size for varying sizes (diameters) of binding combs.

Thereby both carrier plates having large binding combs and also carrier plates having smaller sizes and therefore greater packing density can be packed, stored and transported in a single container.

It is also advantageous if the rows of retaining strips are disposed parallel to one another.

Consequently the binding combs can not obstruct one another during the provision. Moreover the available area of the carrier plate can be utilized in the best possible manner for provision with binding combs.

When providing with binding combs, which may take place both with manually operated and also automatic machines, indentation tools act from above on a row of retaining strips and bend the strips downwards, as already mentioned, so that the binding combs supplied from below in a retaining device partially snap into the opening created in this manner. By virtue of the already mentioned elasticity of the retaining strips, the binding combs are adequately retained and can be easily removed again for the binding of the loose-leaf systems.

In the following operating cycles the same tools can likewise act on the next rows of the retaining strips advantageously disposed parallel. The supply of the carrier plates may occur by varying means, e.g. via a belt conveyor or by means of rolls or cylinders.

It is very expedient if for this purpose a transport edge is provided on the carrier plate. The rows of retaining strips should be disposed on the carrier plate in such a manner that the transport edge remains at right angles to these rows on either side.

It is also very expedient to provide the transport edge with a rectangular recess in each case on its outer edges, so that the transport means, such as rolls or cylinders, can move the carrier plate without obstruction.

It is also very advantageous to provide positioning openings, which are directly associated with the rows of the retaining strips, extending in a line therewith, in at least one of these transport edges.

The positioning openings can be shaped as desired. When the carrier plate is positioned by means of a light barrier, a square or rectangular shape of the positioning openings is advantageous. If the carrier plate is to be positioned in another manner, round holes or openings of other shapes can be used.

These positioning openings form a so-called reference row, by which the carrier plate experiences no undesired deviation in position and thereby errors can be avoided during the provision with binding combs.

For the improvement in the rigidity and for an increase in the moment of resistance of the carrier plate respectively, it is very advantageous if the carrier plate has lateral folding edges disposed parallel to the rows of retaining strips.

The folding edges should be bent roughly at right angles towards the component side. Thus it is possible to use very thin material for the carrier plate, which is very favourable for the weight, the stackability, the material consumption and the ease of working such as e.g. that of the cutting of retaining strips.

Of course the folding edge may also be provided on all four sides of the carrier plate, so that the carrier plate has the highest possible rigidity. In this case regard must of course be paid to the fact that correspondingly suitable devices are to be provided to transport the carrier plate.

The carrier plate may also be made from various materials such as metal, plastics or cardboard (paper). For reasons relating to the protection of the environment, cardboard seems to be the most suitable as a good recyclable material.

The transport edge may advantageously run parallel to the folding edges.

An exact positioning of the carrier plate for covering with the individual binding combs may also be guaranteed hereby. In this case exact positioning can likewise be verified by light barriers.

A very good stackability of the individual carrier plates with the binding combs disposed thereon can be guaranteed in that the folding edges are at least approximately as high as the height of the binding combs.

The individual carrier plates may consequently always be placed with their underside on the upwardly bent folding edges of the carrier plate lying underneath. Thereby a carrier plate which is located right at the bottom in a pile of carrier plates and respectively the binding combs disposed on this carrier plate are prevented from suffering damage by the fact that the mass of the carrier plates lying on top thereof acts on the binding combs of the lowest carrier plate.

BRIEF DESCRIPTION OF THE DRAWINGS

An exemplified embodiment of the invention is described in principle below by means of drawings.

DETAILED DESCRIPTION OF THE INVENTION

Figure 1:
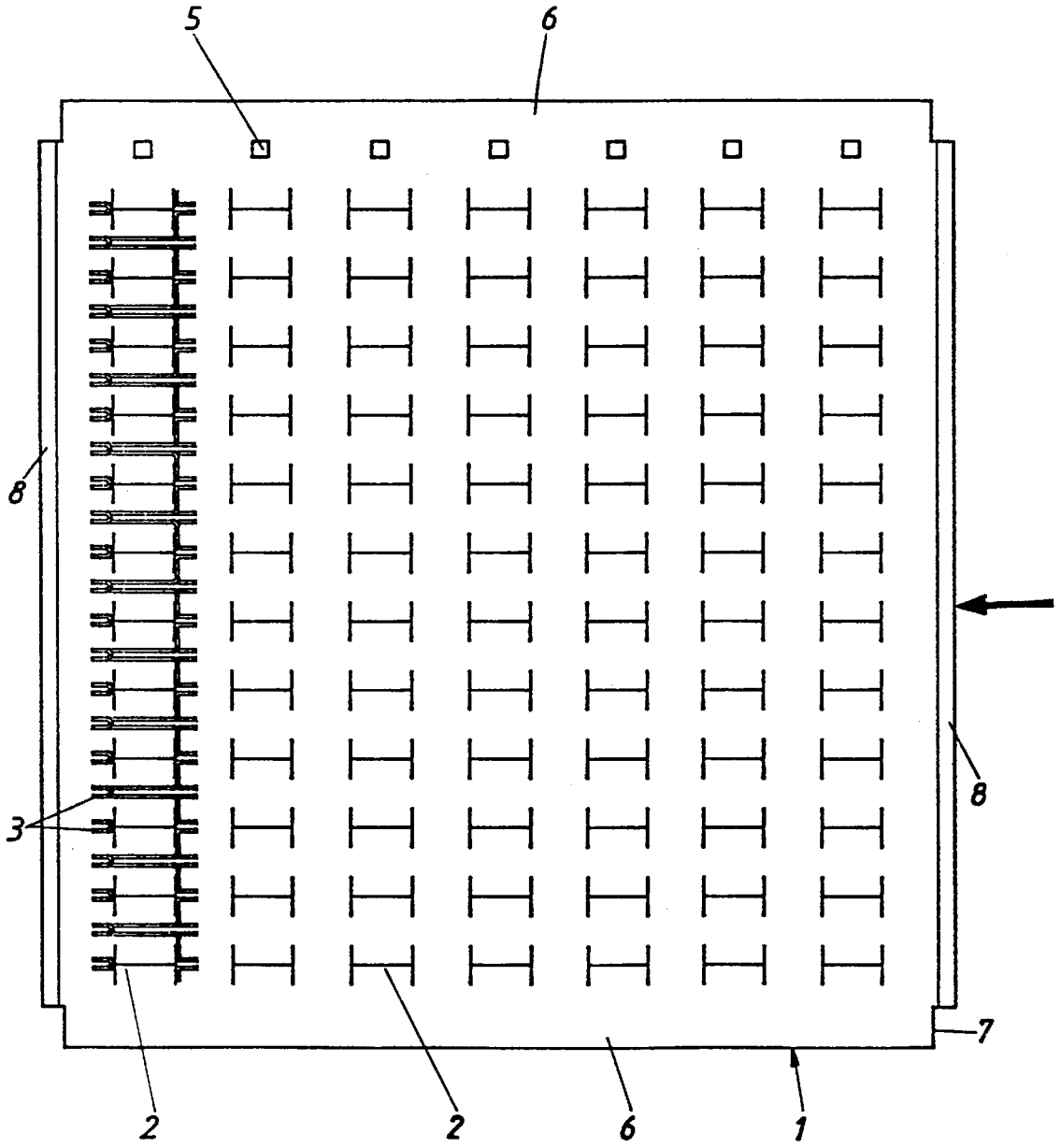
FIG. 1 shows the plan view of a carrier plate for 7 binding combs with a represented binding comb.

A carrier plate 1 is made from environmentally friendly disposable cardboard, but may also be made from another suitable material, such as e.g. plastics. The carrier plate 1 is approx. 333 mm wide and approx. 350 mm long. As represented in FIG. 1, the carrier plate 1 has seven vertical rows of retaining strips 2 for seven binding combs 3 or binding elements respectively each with a diameter of ⅞" (22.23 mm) or ¾" (19.05 mm), with one row in turn consisting of twelve retaining strips 2. In total 84 retaining strips 2 are disposed evenly and parallel to one another on the carrier plate 1.

Figure 3:
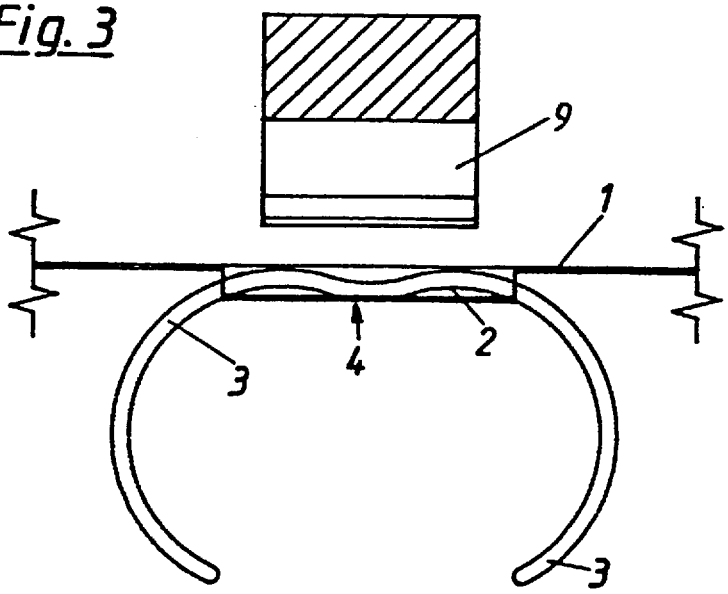
FIG. 3 shows a binding comb retained on a carrier plate in front view in a greatly enlarged representation.

The retaining strips 2 are cut in an H-shape into the carrier plate 1, with the crossbar of the H-shaped retaining strips 2 enclosing a so-called base region 4 (as can be seen in FIG. 3) of the binding comb 3. The spacing or the division for the retaining strips 2 inside a row is approx. 1"=25.4 mm. The retaining strip 2 itself is approx. 22 mm wide and 14 mm high. The upper retaining strips 2 shown in FIG. 1 are disposed with a spacing of approx. 40 mm from the upper edge. The horizontal spacing, i.e. the spacing from one row shown vertically in FIG. 1 to the next, is approx. 43 mm.

At a distance of approx. 18 mm from the upper edge of the carrier plate 1 positioning openings 5, also numbering seven, are associated with the seven rows of retaining strips 2. These positioning openings 5 run in the same alignment as the rows of the retaining strips 2. They are consequently parallel and provided precisely centrally over each row at a distance of approx. 15 mm from the upper retaining strips 2 and serve for the exact positioning and prevention of deviations in the position of the carrier plate 1, during its mechanical transport and provision with the binding combs 3. The positioning openings 5 are here shown in a square shape and have an edge length of approx. 6 mm. However these could equally be designed round, for example. It is possible to locate the positioning openings 5 e.g. via light barriers or other suitable measuring devices.

So that the transport means, such as rolls or cylinders, can operate without obstruction to convey the carrier plate 1, a sufficiently large transport edge 6 is provided above and below the rows of the retaining strips 2 in each case. The direction of transport of the carrier plate 1 is represented by an arrow in FIG. 1.

However alternatively a tractor feed of the carrier plate 1 would also be possible, as is known in conjunction with the transport of paper in printers for data processing equipment. For this purpose the carrier plate 1 would have to be provided with a suitable perforation.

The outer edges of the transport edge 6 are in each case provided with a rectangular recess 7 of approx. 8 mm wide and approx. 15 mm long.

To bestow the carrier plate 1 with the required stability, despite its material-saving low thickness, both outer sides are provided with a folding edge 8 of approx. 5 mm wide.

Figure 2:
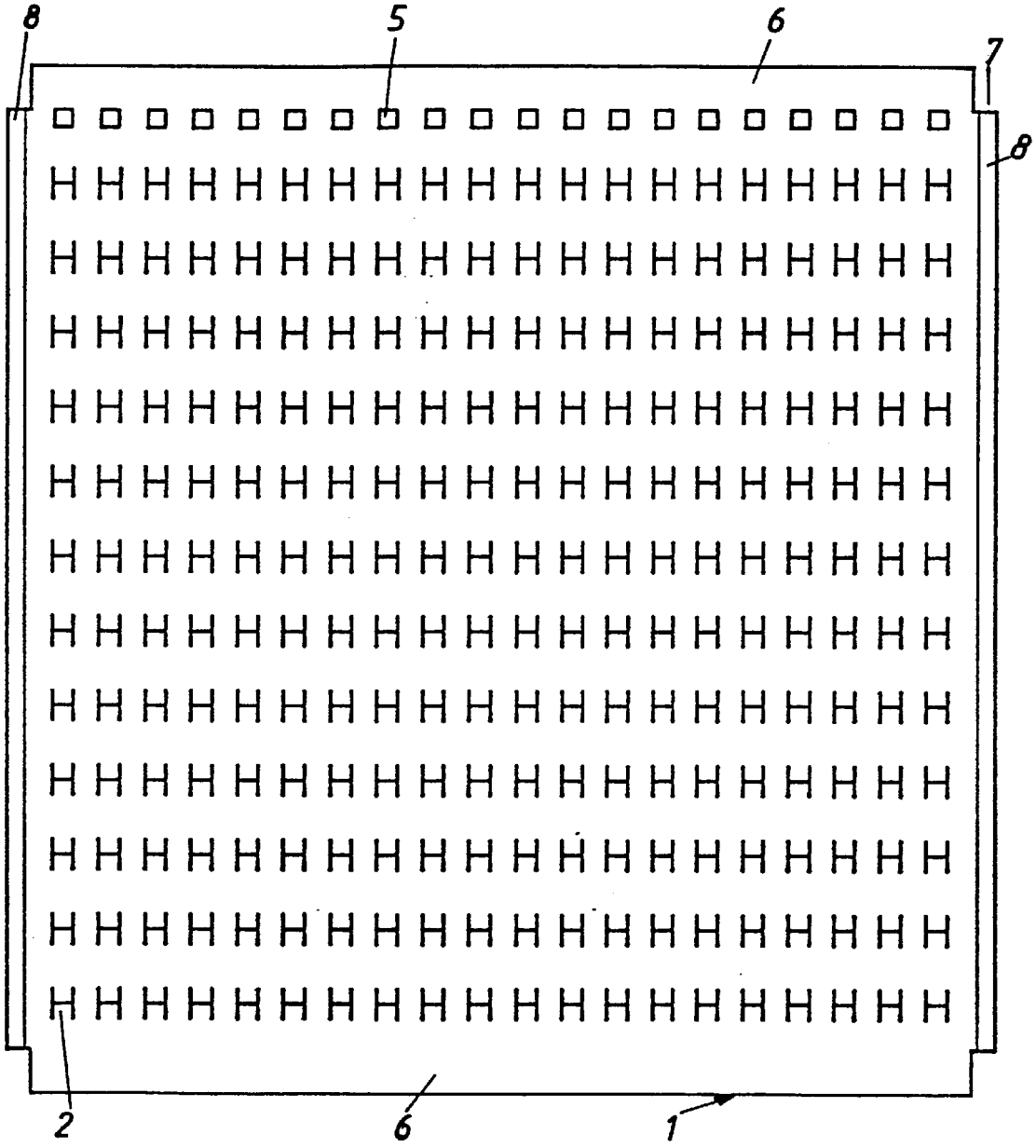
FIG. 2 shows the plan view of a carrier plate for 20 binding combs.

The folding edge 8 extends parallel to the rows of retaining strips 2 and is bent by approx. 90° to the component side. In FIGS. 1 and 2 the folding edge 8 is shown not yet bent.

In FIG. 1 it can also be clearly seen how the individual turns of a binding comb 3 are constructed and how they engage in the retaining strips. In this case the retaining strips 2 do not enclose each base region 4, but only every second or third, corresponding to the chosen division of the retaining strips 2. A flat and secure retention and also removal of the binding combs 3 is possible therewith.

In FIG. 2 a carrier plate 1 of the same format with recesses 7, transport edges 6 and folding edges 8 of equal size is represented.

Of course in this carrier plate 1 by virtue of the higher specified packing density of the binding combs 3 (because they have smaller diameters) 20 rows of retaining strips 2 are provided for 20 narrower binding combs having a diameter of approx. ¼" (6.35 mm) or also 3⁄16" (4.76 mm).

As in FIG. 1, twelve retaining strips 2 disposed with a division of 1" (25.4 mm) are likewise provided inside a row, so that in FIG. 2 a total of 240 retaining strips 2 are evenly distributed.

The spacing from one positioning opening 5 and respectively from one row of retaining strips 2 to the next is only approx. 15.5 mm in this variant.

The "HI"-crossbar, i.e. the width of the retaining strips 2, in this case only measures approx. 7 mm, whilst the length is approx. 10 mm.

Of course other spacings between the rows of retaining strips may be chosen, according to the desired packing density.

Figure 4:
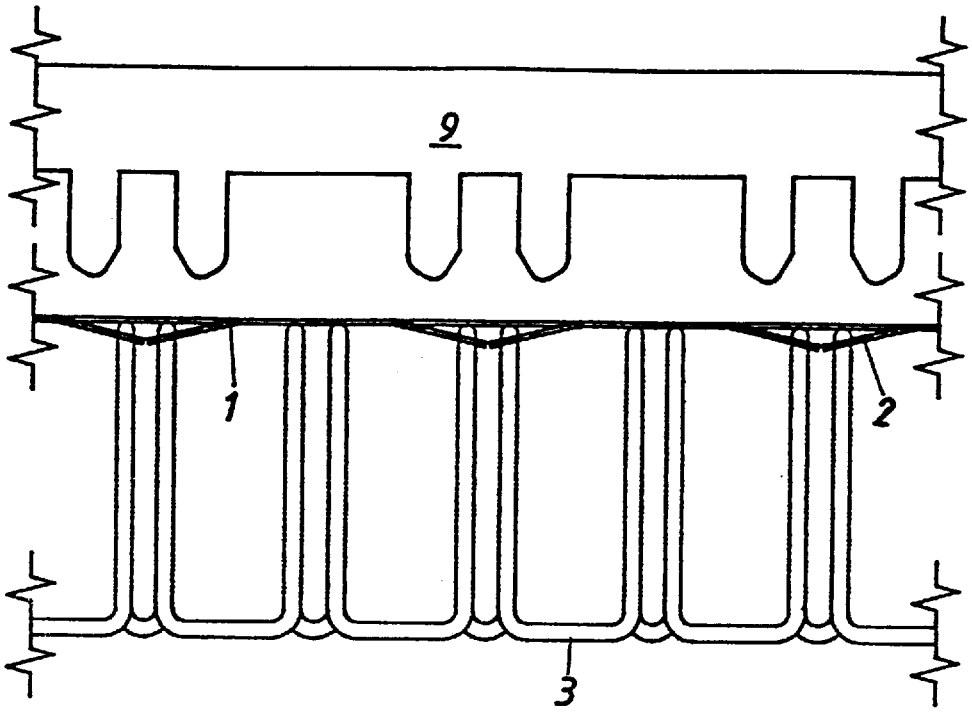
FIG. 4 shows a binding comb retained on a carrier plate in side view with the indentation tool represented in a greatly enlarged representation.

The side view of a greatly enlarged detail of a binding comb 3 retained on the carrier plate 1 can be seen in FIG. 4.

Pneumatically, mechanically or hydraulically acting indentation tools 9 from above effect the bending of the retaining strips 2 downwards. As mentioned, the retaining strips 2 are forced downwards, whereby the base region 4 of the binding combs 3 (as can be seen in FIG. 3) engages into the now opened crossbar of the H-shaped retaining strip 2 and by the elastic springing back of the retaining strips 2 retains the binding combs 3. The binding combs 3 retained in this manner are consequently precisely formatted and can be easily manually or mechanically removed at any time.

In spiral and oval binding combs 3 such as those represented in FIGS. 1, 3 and 4, which are open in the longitudinal direction, the loose-leaf systems only need to be laid into the open loops of the binding combs 3 with the appropriate number of corresponding openings. Then the binding combs 3 can be shaped to form a closed ring spiral.

I claim:

1. A combination of a spiral binding comb and a package, said binding comb having a plurality of adjacent comb elements in a continuous length for the binding of loose-leaf systems each of said comb elements having a bottom portion, said package having a carrier plate with a row of comb holders, each of said comb holders having opposing retaining strips pivoting outwardly to an open position for securing the binding comb, each of said comb holders being in the shape of an H, each of said H's corresponding to said comb and positioned to engage said bottom portion, said comb holders engaging and holding siad bottom portion of said comb elements onto said carrier plate, said carrier plate having lateral folding edges extending parallel to said row, said folding edges being folded at right angles toward said comb holders.

2. The combination of claim 1, wherein said carrier plate includes a plurality of rows of said strips, the spacing between the rows of strips and also the spacings between the individual strips within a row can be varied according to the size and packing density of the binding combs.

3. The combination of claim 2, characterized in that the rows of retaining strips are disposed parallel to one another.

4. The combination of claim 1, positioning openings directly associated with the rows of retaining strips in an edge border of said carrier plate.

5. The combination of claim 1, characterized in that the carrier plate is made from cardboard.

6. The combination of claim 4, wherein the positioning openings extend parallel to the folding edge.

7. The combination of claim 1, wherein said binding comb are of a certain height and the height of said folding edge are of a height which corresponds at least approximately to the height of the comb.

* * * * *